United States Patent [19]

Ortner

[11] Patent Number: 4,496,051

[45] Date of Patent: Jan. 29, 1985

[54] CONTAINER WITH INFORMATION-CARRYING ELEMENT

[76] Inventor: Georg J. Ortner, Thome Strasse 14, D-3300 Braunschweig, Fed. Rep. of Germany

[21] Appl. No.: 464,509

[22] PCT Filed: May 19, 1982

[86] PCT No.: PCT/EP82/00106

§ 371 Date: Jan. 28, 1983

§ 102(e) Date: Jan. 28, 1983

[87] PCT Pub. No.: WO82/04428

PCT Pub. Date: Dec. 23, 1982

[30] Foreign Application Priority Data

Jun. 9, 1981 [DE] Fed. Rep. of Germany ..... 3122775
Apr. 23, 1982 [DE] Fed. Rep. of Germany ..... 3215221

[51] Int. Cl.[3] ..... B65D 23/00; B65D 51/24; G09F 3/04

[52] U.S. Cl. ..... 206/459; 206/216; 206/38; 206/37; 220/375

[58] Field of Search ..... 206/216, 232, 231, 38, 206/459, 37, 823; 220/375

[56] References Cited

U.S. PATENT DOCUMENTS

| | | | |
|---|---|---|---|
| 2,422,314 | 6/1947 | Rheinstrom | 206/232 |
| 2,965,222 | 12/1960 | Kidwell | 206/232 |
| 3,023,925 | 3/1962 | Sher | 206/45.34 |
| 3,028,070 | 4/1962 | Schnur et al. | 206/459 |
| 3,069,006 | 12/1962 | Snell | 206/232 |
| 3,256,978 | 6/1966 | Srigley et al. | 206/232 |
| 3,283,717 | 11/1966 | Balch | 206/37 R |
| 3,419,179 | 12/1968 | Deuschle et al. | 220/375 |
| 3,846,927 | 11/1974 | Geffen | 24/11 CT |
| 4,318,495 | 3/1982 | Wood | 220/375 |

FOREIGN PATENT DOCUMENTS

| | | | |
|---|---|---|---|
| 249973 | 7/1947 | Switzerland | 206/459 |

*Primary Examiner*—William T. Dixson, Jr.
*Assistant Examiner*—Brenda J. Ehrhardt

[57] ABSTRACT

The container (2) for small material samples is inseparable from an information-carrying element fixed preferably in order to be in evidence when using the container.

11 Claims, 10 Drawing Figures

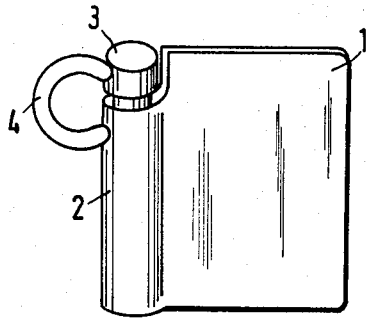
Fig.1
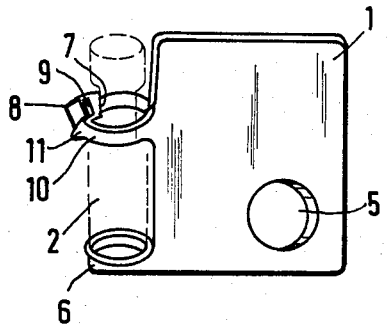
Fig. 2
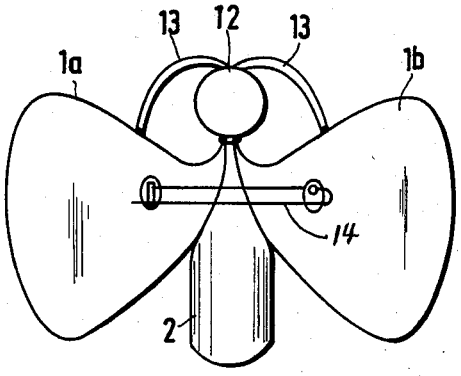
Fig.3
Fig. 4
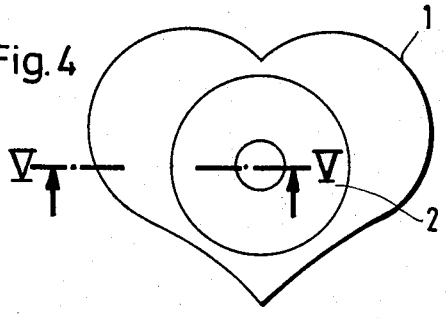
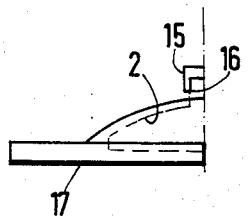
Fig. 5

Fig.6
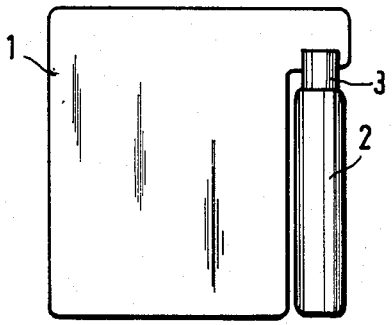
Fig.7
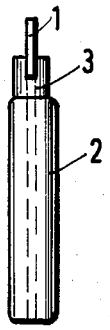
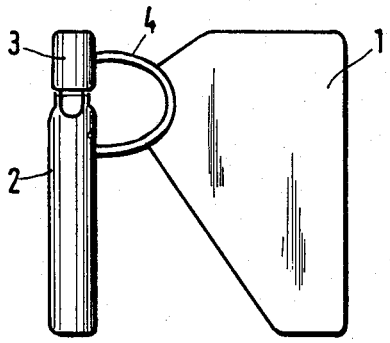
Fig.8
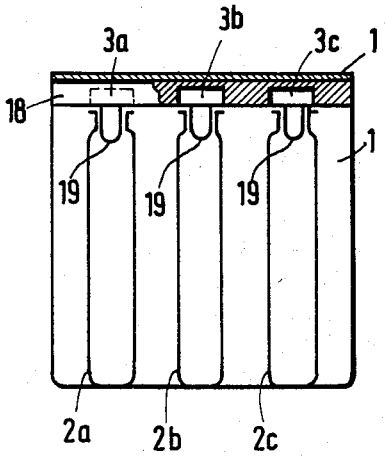
Fig.9
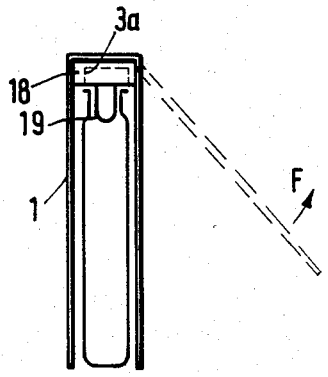
Fig.10

CONTAINER WITH INFORMATION-CARRYING ELEMENT

The object of the invention is a container for smal material samples, to which an information-carrying element is attached, having particular reference to perfume sample containers with an advertising tab.

A commercial need is frequently observed, especially with reference to the use of small containers, of providing such containers with an additional information-carrying element. In the case of bottle-type containers, use is made of small brochures suspended loosely from the neck of the bottle, or labels attached to the neck of the bottle or adhered to the bottle, or attached to the bottle label by a tear-off connection. Information-carrying elements of this type are especially advantageous if the container surface itself affords too little room. Typical applications are small cans or bottles for pharmaceuticals, cosmetics, processed food samples, adhesives, paints, lubricants, textile care products, perfumes, etc., whereby the aformentioned materials are introduced into the appropriate containers with differing consistency.

The invention is based upon the task of creating a combination of container and information-carrying element for the aforementioned or similar applications, said element affording sufficient space for information purposes, e.g. as advertising, instructions, warnings, etc., wherein the information-carrying element and the container supplement each other with respect to their manipulation and the information-carrying element remains attached to the container even when the latter is in use.

The above mentioned task is fulfilled in the nature of an invention, with respect to its primary application as a sample container for perfume, in that an advertising tab of any desired configuration is inseparably connected, directly or indirectly, to the container to form a product unit. In addition to this primary area of application with perfume, numerous other applications, e.g. those mentioned at the outset, can be advantageously achieved.

In terms of the solution under application, it does not matter whether the advertising tab is fixed inseparably to the container itself or to a holder enclosing the container, to the container stopper or to a connecting element between the container stopper and the container itself. What is important in this instance is that the advertising tab cannot be removed without causing the destruction of the container or its stopper. If the advertising tab is connected indirectly to the container, then the connecting element e.g. the holder, must be inseparably connected to the container.

In accordance with one especially advantageous design, provision is made that the product unit be manufactured in one piece, e.g. as a plastic injection molding or by application of an inseparable mechanical connecting means between the advertising tab and the container. What is decisive in every instance is that the container and the information-carrying element are connected with each other in such a way that they can only be separated by the destruction of the product unit. In this way the information or advertising function, together with the material enclosed within the container, is assured throughout the entire use life of the material. In terms of the preferred area of application, the perfume sector, the information-carrying element in the form of an advertising tab can be employed either for the contents themselves or for any other promotion purpose. A fashion boutique which distributes to its customers perfume sample containers having an advertising tab in the form of the product unit under application, achieves an additional promotion impulse with each use of the perfume, if the advertising tab is provided with an appropriate print message having reference to the boutique.

In terms of the invention, numerous designs are conceivable, whereby reference is made especially to the designs indicated in the sub-claims. In the case of small perfume bottles it is advantageous to create the advertising tab as a flat body extending parallel to the axis of the bottle, whereby the advertising tab and the container or the advertising tab and the bottle holder preferably form a single plastic element. The container can also display any desired form variant from that of a bottle; the same is true for the advertising tab which can assume a three-dimensional as well as a flat form. In particular, the surface of the advertising tab can be treated in a great variety of ways, e.g. by printing, labelling, coating, e.g. through a galvanizing process or the application of a photo-sensitive layer for the employment of photographic technology.

A number of design examples of the invention follows, described with reference to the drawing. Shown are:

FIGS. 1–4 each showing a different model of a product unit comprised of a sample container and an advertising tab, FIG. 5 a cross-section along axis V—V of FIG. 4, FIG. 6 a further model with the advertising tab attached to the container stopper, FIG. 7 a side view of FIG. 6, FIG. 8 a variant with the advertising tab indirectly attached, FIG. 9 a model with three sample bottles and FIG. 10 a side view of FIG. 9.

The product units shown in the drawing each consist of plastic injection moldings, e.g. of polyethylene or polypropylene. In FIGS. 1, 2 and 4, one-piece advertising tabs 1 are shown, that in FIG. 4 having the form of a heart-shaped leaf. The surfaces of this leaf serve as carriers for the desired information, either in conjuction with the contents of the container 2 or independent of the same. In FIG. 1 the container 2 is a plastic bottle tip-stretched to the advertising tab with a stopper 3, which is connected to the bottle 2 by a flexible connecting element 4. A tip-stretched strip 1' serves as a holding means to hold the tab to the upper end of the container. In FIG. 2 a bottle-shaped container 2, e.g. of glass, is provided independent of the advertising tab 1 which is provided with a hole 5, the container being seated, e.g. adhered, in a base section 6 which is connected as a single piece to the advertising tab; which in this case is provided with holding means in the area of tapered neck section 7 in form of two tip-stretched strips to. One strip 8 displays an eyelet 9; the other strip 10 displays at its end a widening 11, which is thrust through the eyelet to create the connection of the two strips 8, 10 and thereby the connection of the tab about the neck section of the container.

The model shown in FIG. 3 displays a divided advertising surface 1*a*, 1*b*, e.g. in the form of two butterfly wings, whereby the container 2 represents the body of the butterfly. The stopper 12 of the container is inseparably connected to the wing-like advertising tabs 1*a*, 1*b* by holding means comprising strips 13 which symbolize the butterfly's antennae. On one of its sides the product unit has, as seen in FIG. 3, a safety pin 14 so that it can also be worn on a garment in a sense as a perfume reserve. The wing-like advertising tabs 1*a*, 1*b* can be color-printed in any desired design and can also accept text information, e.g. a trade mark representation.

In FIGS. 4 and 5 a central container 2 is surrounded by a plastic membrane, which forms a heart-shaped advertising tab 1. A screw top closure 15 is fixed on the container neck 16. The reverse side 17 of the advertising tab 1 affords considerable space for information. In FIGS. 6 and 7, the stopper 3 of the container 2 is attached to a cutout section of the advertising tab 1 conforming to the shape of the container, so that the container 2 can be freely suspended at its closure.

In FIG. 8 a plastic container 2 is connected to its stopper 3 by means of a flexible connecting element 4 to which the advertising tab is connected.

As is evident from FIGS. 1 to 8, in each of the embodiments disclosed, the advertising tab has a surface area substantially larger than the surface area of the container. Furthermore, in each of the embodiments, the information tab will be seen to extend laterally from or outwardly of the container outer surface and has a vertical extent at least equal to that of the container.

FIGS. 9 and 10 show two views of one model with three sample containers 2*a*, 2*b*, 2*c* arranged side by side with the stoppers being partially molded in a plastic strip 18, whereby their closure stoppers 19 project from the strip 18 for attachment of the containers. In addition, a U-shaped advertising tab 1 is tip-stretched from the strip 18, the advertising tab being hinged so as to open out as shown by arrow 1 on at least one side for removal of the containers 2*a*, 2*b*, 2*c*.

I claim:

1. A combination including a vertically oriented container with a product dispensing opening therein, the container being of a size too limited to carry sufficient advertisement and/or other information relative to the product within the container, and further including as part of the combination an information tab with advertising and/or other information thereon and having a surface area substantially larger than the surface area of the container, said information tab extending laterally from the container outer surface and having a vertical extent at least equal to that of the container, stopper means for closing the container dispensing opening for preventing dispensing of the container product when the stopper means is applied to the container to close the opening, and holder means for said information tab, said holder means effectively inseparably connecting the information tab to the container, said container, said information tab, said stopper means and said holder means comprising an injection molded one piece product unit which, on attempted separation of the information tag from the container, is destroyed.

2. A container in accordance with claim 1, wherein the container has a stopper inseparably connected to the product unit.

3. A container in accordance with claim 1, characterized by the fact that the advertising tab is connected to said holder means which accepts the container.

4. A container in accordance with claim 1, wherein the advertising tab is attached to the stopper of the means of the container.

5. A container in accordance with claim 1, wherein the advertising tab is attached to said holder means between the container stopper means and the container itself.

6. A container in accordance with claim 3, characterized by the fact that the holder means is inseparably connected to the container.

7. A container in accordance with claim 1, wherein the holder means comprise strips which encircle the neck portion of the container.

8. A container in accordance with claim 1, wherein the advertising tab extends laterally from opposite sides of the container.

9. A container in accordance with claim 1, wherein the product unit has a grip element.

10. A container in accordance with claim 1, wherein the container has a closure attached to a cutout section of the advertising tab, the cutout section accommodating the container whereby the container is freely suspended at its closure.

11. A container in accordance with claim 1, wherein the container is an elongated bottle form, the advertising tab comprising a flat element extending parallel to the axis of the container.

* * * * *